United States Patent [19]

Rottler et al.

[11] 4,189,871

[45] Feb. 26, 1980

[54] HONING MACHINE

[75] Inventors: Donald B. Rottler, Seattle; David Engnell, Issaquah, both of Wash.; Donald B. Rottler, Seattle

[73] Assignee: Rottler Boring Bar Co., Kent, Wash.

[21] Appl. No.: 911,494

[22] Filed: Jun. 1, 1978

[51] Int. Cl.[2] ..... B24B 5/08

[52] U.S. Cl. ..... 51/34 J; 51/165.93

[58] Field of Search ..... 51/34 R, 34 D, 34 H, 51/34 J, 47 J, 165.92, 165.93; 408/10, 11, 130, 239, 709

[56] References Cited

U.S. PATENT DOCUMENTS

| | | | |
|---|---|---|---|
| 2,164,811 | 7/1939 | Floss | 51/34 D |
| 2,312,540 | 3/1943 | Fulmer | 51/34 J |
| 3,273,423 | 9/1966 | Rottler | 408/709 X |
| 3,324,602 | 6/1967 | Wright | 51/34 R |
| 3,369,327 | 2/1968 | Estabrook | 51/34 J |
| 3,393,472 | 7/1968 | Sunnen | 51/34 H |

*Primary Examiner*—Gary L. Smith

*Attorney, Agent, or Firm*—Seed, Berry, Vernon & Baynham

[57] ABSTRACT

A "beam stroker" type of honing machine which can, at the operator's option, be power stroked by means of a double-acting pneumatic cylinder or manually stroked. Both travel limits can be varied by the operator. A hydraulic double-acting cylinder system functions to limit the stroking speed and has a needle valve adjustment to vary the speed.

17 Claims, 6 Drawing Figures

FIG. 4
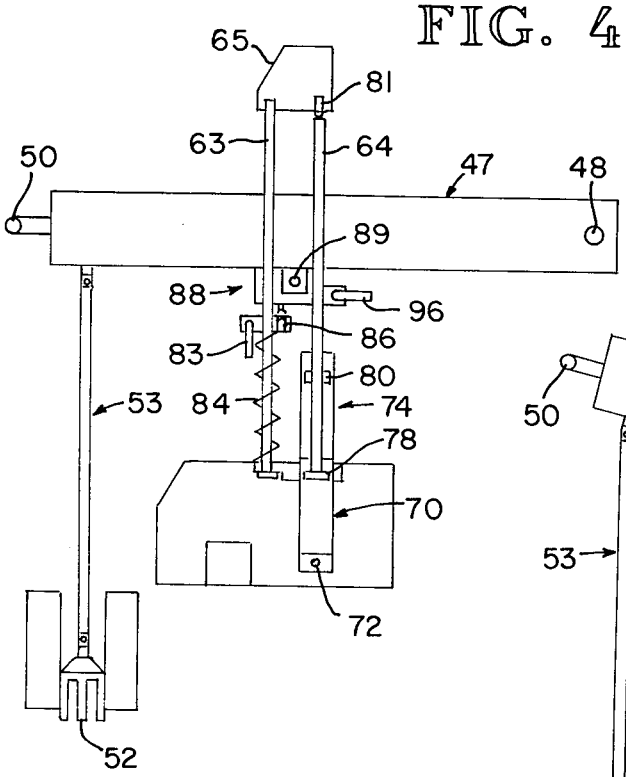
FIG. 5
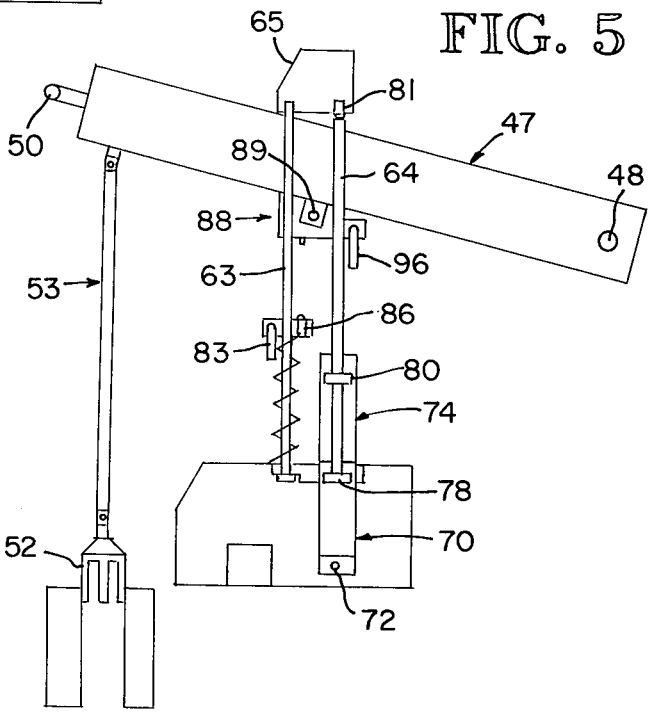
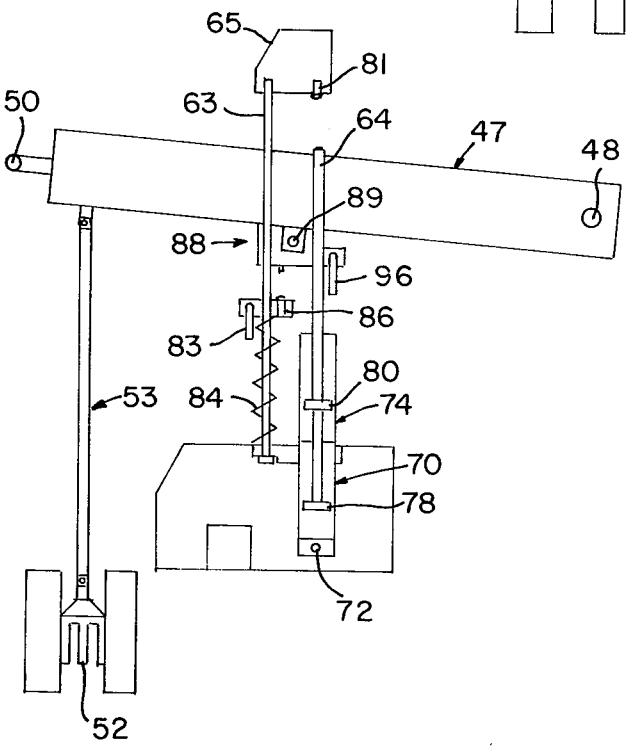
FIG. 6

HONING MACHINE

BACKGROUND OF THE INVENTION

1. Field of the Invention

The present invention relates to honing and abrading machines and the like, and more particularly to a machine by honing cylindrical surfaces such, for example, as the cylindrical bores in engine blocks.

2. Description of the Prior Art

Relatively inexpensive honing machines which are simple to operate are needed for finishing rebored engine blocks in relatively small engine reconditioning establishments such as automobile repair and maintenance shops. Preferably, such machines should have the capability, at the operator's election, of either power stroking or manual stroking the honing tool. Further, such honing machines should have a bottom dwell capability, i.e. the operator should be able to keep the honing tool in operation for a selected period of time at the bottom of the stroke of the honing tool.

The machine of the present invention is of the type often referred to as a "beam stroker", the honing tool being suspended from a pivoted arm or beam containing the drive mechanism for the tool. The beam is swung up and down to responsively vertically reciprocate the honing tool in the work piece. In such a machine it is necessary to either provide a variable height table for the work piece or to adjust the lower travel limit of the honing tool, and in either case the upper travel limit of the honing tool must be variable in accordance with the length of the cylinder bore or other cylindrical surface being honed. It is preferred to have both the upper and lower limits variable.

SUMMARY OF THE INVENTION

The present invention aims to provide an economical "beam stroker" type of honing machine which is of relatively simple contruction having both power and manual operating modes.

Another object is to provide such a machine having provision for quick and easy adjustment of both upper and lower travel limits of the honing tool and which only requires a single adjustment of each limit to properly set both limits.

Still another object is to provide such a machine in which the power stroking is air actuated and the stroking is variable by a simple adjustment.

A further object is to provide an air actuated stroking system in which bottom dwell of the honing tool can be easily accomplished by the operator.

In carrying out the objects of this invention there is provided a beam stroker type of honing machine in which the rocking beam containing the drive mechanism for the honing tool has an air cylinder pivotally mounted on the base of the machine and having its piston rod extending through an upper clamp unit pivoted on the beam. The setting of this upper clamp unit along the piston rod sets the upper travel limit of the beam during a power stroke. The air cylinder carries a parallel second rod of fixed length which slides through the upper clamp unit on the opposite side of its pivot from the piston rod. A lower clamp unit is sleeved on the second rod to act as a variable stop to set the lower limit of beam travel by engagement of the upper clamp unit with the lower clamp unit. The air cylinder has a control circuit which includes upper and lower valves on the top of the second rod and on the lower clamp unit which are engaged, respectively, by the top of the piston rod and by the upper clamp unit to alternately charge and vent the ends of the air cylinder for reciprocation of the piston rod. For manual operation the upper clamp unit is released.

BRIEF DESCRIPTION OF THE FIGURES OF THE DRAWINGS

In the accompanying drawings:

FIGS. 4 and 5 are schematic side elevational views showing, respectively, the machine when the lower and upper limits are set; and FIG. 6 is a schematic side elevational view showing the machine in operation part way through a honing stroke.

DETAILED DESCRIPTION OF THE PREFERRED EMBODIMENTS

Figure 1:
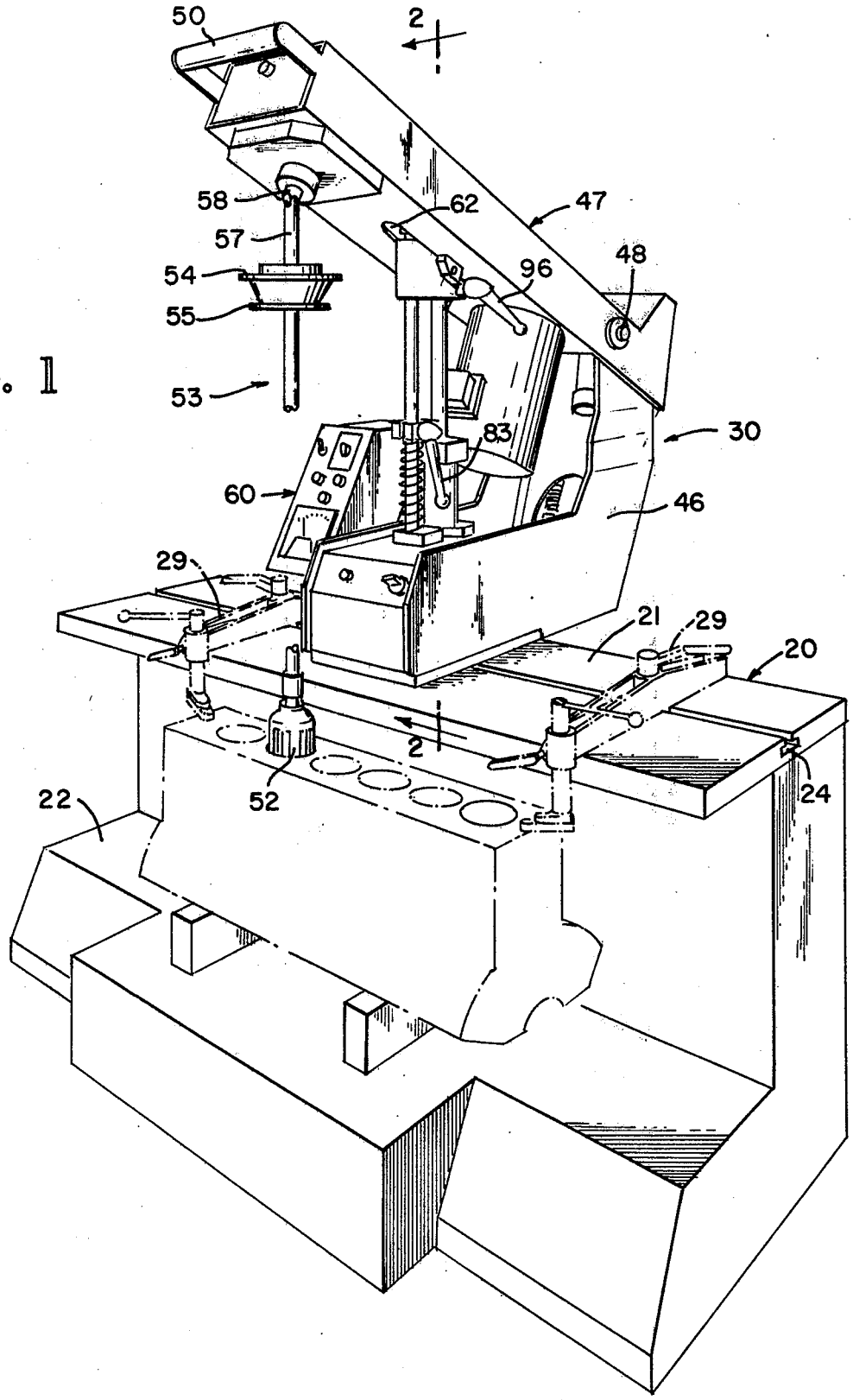
FIG. 1 is a perspective view of a honing machine embodying the present invention.

As best shown in FIG. 1 the honing machine includes a stationary bed 20 having an upper planar slide surface 21 which is elevated above and offset laterally from a table 22 for receiving an engine block and a suitable fixture (not shown). The slide surface 21 has a longitudinal slideway or keyway 24 of an inverted-T-cross-section for receiving anchoring keys 26 for a honing unit 30 and suitable clamping units 29 provided to hold the engine block fixed on the table 22. These clamping units 29 can be of the type shown in U.S. Pat. No. 3,273,423.

The key 26 for the honing unit 30 is mounted at the lower end of a pull bolt 31 which extends through a slide guide 32 anchored by bolts to the base plate 33 of the housing for the honing unit. At its upper end the pull rod 31 has a nut 34 bearing down on a spherical washer 35 in turn engaging a spherical seat 36. This seat 36 is mounted on a generally U-shaped cross-member 37 bridging between a pair of laterally extending parallel lever arms 38, only one of which is shown. Each lever arm 38 is forked at its forward end to receive the piston rod 40 of a respective air cylinder unit 41 and make a pivotal connection thereto by a pin 42. At its rear end the lever arm 38 seats on a fulcrum block 43 fixed to the base plate 33.

With the described arrangement, when the piston rods 40 of the two air cylinders units 41 are extended simultaneously responsive to charging of the cylinders, the lever arms 38 pivot on the fulcrum blocks 43, thereby responsively tensioning the pull rod 31 to force the anchoring key against the upper face of the slideway 24 while the bottom of the base plate 33 reacts against the slide surface 21 of the bed 20. The overall arrangement thus far described is essentially the same as used to anchor the boring unit in U.S. Pat. No. 3,273,423.

In the same manner as with the boring unit in U.S. Pat. No. 3,273,423 the base plate 33 has a pair of relatively short alined shallow longitudinal air-lift grooves along its under side. These grooves are preferably located beneath the center of balance of the honing unit front to back so that when the grooves are selectively charged with compressed air after release of the anchoring key 26, the resulting lift force exerted on the base plate 33 makes it easy to manually move the honing unit relative to the bed 20. The grooves are indicated at 129 in the schematic, FIG. 3.

The housing of the honing unit has side plates 46 which extend upwardly at the rear to support a swinging power head unit 47 which extends forwardly from a rear pivot connection 48 and is spring counterbalanced in favor of a raised position. A handle 50 is provided at the forward end of the head unit 47 so that it can be manually swung up and down. The head unit 47 is sufficiently longer than the base of the honing unit to project forwardly beyond the slide surface 21 and permit the honing tool 52 of a honing tool assembly 53 to be selectively moved into cylinder bores of an engine block clamped on the bed 22. The honing tool 52 and related drive and radial adjusting mechanism comprising the assembly 53 can be the same as that disclosed in British Pat. No. 1,200,085. In such an assembly 53 manual manipulation of rings 54, 55 cause radial expansion and retraction of the honing stone holders of the tool 52. The power input shaft 57 of the honing assembly 53 has a universal drive connection 58 at the top with an output shaft projecting downwardly from the forward portion of the head unit 47. Within the head unit is a suitable motor and drive train with controls located in a control box 60 mounted on one of the side plates so that the control panel is convenient to the operator.

The head unit 47 has a central opening 62 therethrough to accommodate a hollow front rod 63, a rear piston rod 64, and a valve carrier 65 mounted on the upper end of the front rod 63 and extending rearwardly to overlie the piston rod 64. At its lower end the front rod 63 is necked and passes downwardly through the forward end portion of a connecting block 67 to which it is fixed by a nut 68. This block 67 is mounted on the upper end of an air cylinder 70 which in turn has an end cap 71 pivotally mounted by pin 72 between a pair of mounting brackets on the base plate 33 behind the slide guide 32 for the pull rod 31. The air cylinder 70 extends upwardly between the lever arms 38 and is alined with an oil cylinder 74 projecting upwardly from the connecting block 67.

Figure 2:
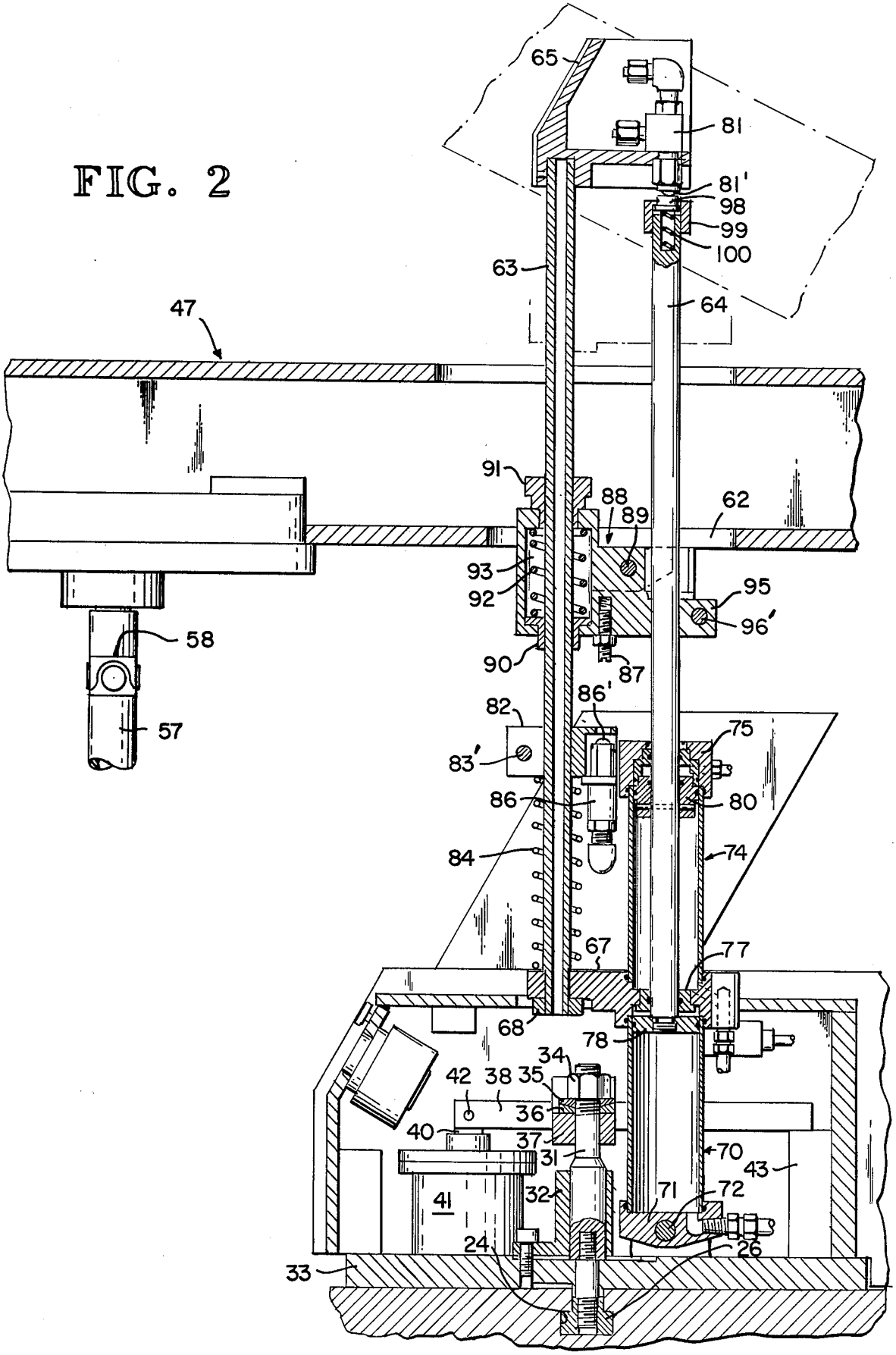
FIG. 2 is a fragmentary vertical sectional view to an enlarged scale taken as indicated in line 2—2 of FIG. 1.

As shown in FIG. 2, piston rod 64 extends downwardly through a packing gland in the head cap 75 of the oil cylinder 74 and then through a packing gland 77 in the connecting block 67 located between the cylinders 70, 74. Mounted on the extreme lower end of the rod 64 is an air piston 78, and spaced thereabove such as to be adjacent the upper end of the oil cylinder 74 when the air piston is at its upper limit of travel, is an oil piston 80. The carrier 65 at the top of the front rod 63 houses an upper travel limit valve 81 arranged to be operated by engagement with the upper end of the piston rod 64 as illustrated in FIG. 2. Preferably the air lines for the valve 81 are threaded down through the rod 63 and make connection with flexible hose coils at the bottom (not shown).

A lower stop unit 82 is sleeved on the front rod 63 and is selectively locked to the front rod by manual operation of an integral C-clamp which is compressed into clamping position by turning a front clamp handle 83 to tighten the clamp screw 83'. It is preferred to provide a compression spring 84 on the front rod 63 to gently urge the clamp 82 to its highest operating position. The function of the lower clamp 82 is to act as a stop and carry a lower travel limit valve 86 which is arranged to have its actuator head 86' engaged by an adjustable stop screw 87. This screw is mounted on a head block 88 which is pivoted at pin 89 on the underside of the head unit 47. In its forward portion the head block 88 has a bumper assembly sleeved on the front rod 63 and comprising a slidable bottom bumper sleeve 90, a fixed top guide sleeve 91, and a compression spring 92 housed in a cylindrical chamber 93. The bumper 90 is arranged to engage the top of the lower stop unit 82 during down swinging of the head unit 47 and the head of the member 91 is arranged to engage the overhead member 65 at the top of the front rod 63 when the head unit 47 is in its parked position favored by the spring counterbalancing. At its rear the head block 88 slidably receives the piston rod 64 and has a C-clamp 95 for selectively locking the head block 88 to the piston rod 64 by operating a handle 96 to tighten the clamp screw 96' when the upper travel limit of the head unit 47 is set as will be described later.

Directing attention to the upper end of the piston rod 64 in FIG. 2, it will be noted that it has a stepped bumper 98 retained by a cap 99 and urged upwardly by a spring 100 housed in an axial bore in the rod 64. Clearance between the end of the rod 64 and the top wall of the cap 99 permits limited travel of the bumper 98. The upper travel limit valve 81 housed in the carrier 65 is arranged such that its actuator head 81' is alined for engagement by the bumper 98. It will be noted from FIG. 2 that when the piston rod is at its upper limit of travel, i.e. the piston 78 is at the top of the air cylinder 70, the bumper 98 actuates the valve 81.

Figure 3:
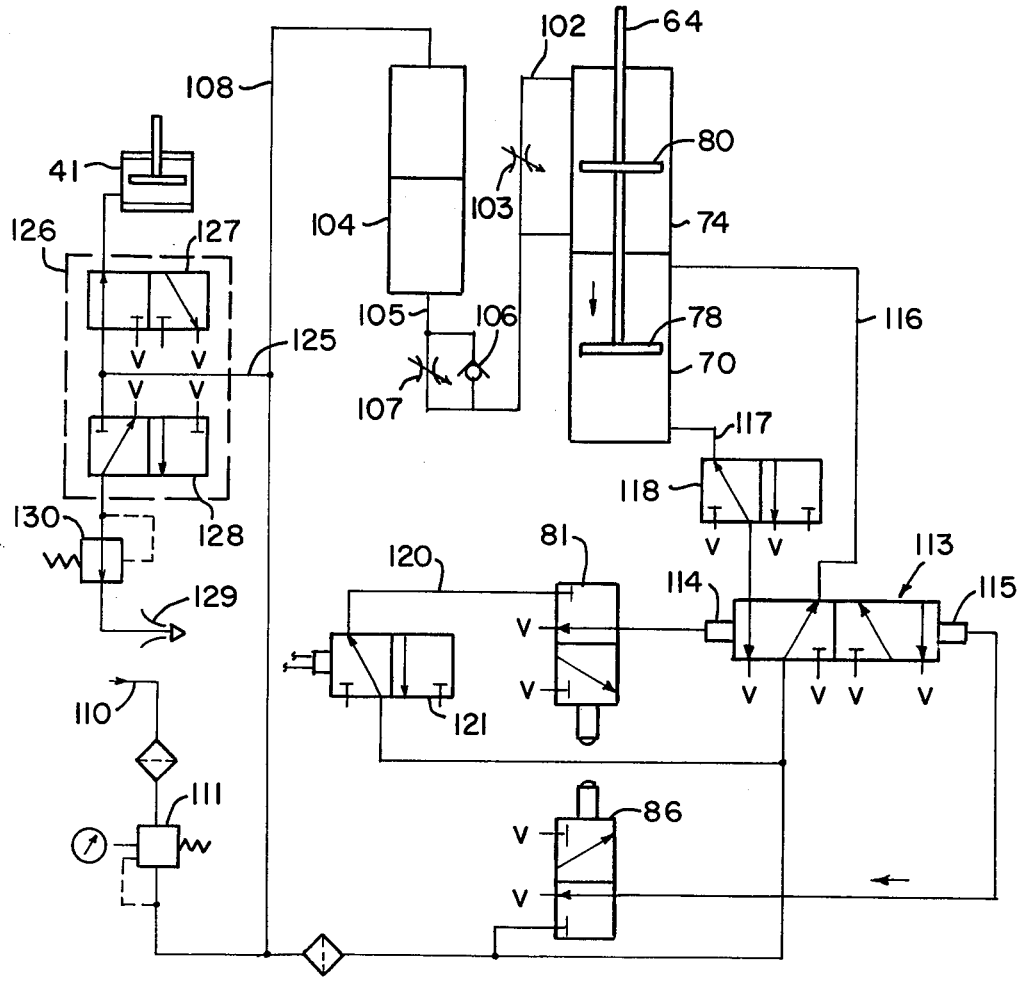
FIG. 3 is a schematic view of the control system for the machine.

Referring to the schematic of FIG. 3, it is seen that the opposite ends of the oil cylinder 74 are hydraulically interconnected by a by-pass line containing a needle valve 103 for controlling the flow rate between opposite sides of the piston 80 to thereby regulate the speed of the piston rod 64. The oil for the cylinder 74 is supplied from an air/oil accumulator 104 having its oil discharge line 105 provided with a check valve 106 which is by-passed via a shut-off valve 107. The pressurized air to the air side of the accumulator 104 is supplied via line 108 from the primary supply line 110 of the system. A regulator 111 controls the overall system pressure and a second regulator (not shown) is preferably provided for step-down of the pressure to the accumulator 104.

A reciprocating control valve 113 with air pilots 114, 115 controls the flow of air through lines 116, 117 to the opposite ends of the air cylinder 70 for reciprocating the rod 64. The line 117 contains a manually operated valve 118 for selectively venting the lower end of the air cylinder 70 when dwell at the lower end of the honing stroke is desired. The air supply line 120 to the upper limit control valve 81 contains a solenoid valve 121 operable to vent the line 120 and cut off air supply to valve 81 and the pilot 114 when the solenoid valve is deenergized. The solenoid valve 121 is energized whenever the machine is turned on for power stroking of the honing tool and is deenergized when the machine is turned off or when manual stroking is being performed.

The air supply line 110 also connects by line 125 to a selector unit 126 containing a 3-way valve 127 for controlling the clamp cylinders 41, and a 3-way valve 128 for controlling air to the grooves 129 in the base 33 to air-float the honing machine. In FIG. 3 the valve 127 is shown in its supply position to the clamping cylinders 41 so that the clamping key 26 is in locking position during the honing operation. When the honing machine is to be moved along the bed 20 to a new honing position at another of the engine cylinders the selector unit 126 is repositioned to shift the valve 127 to its vent position releasing the clamping key 26 and shift the valve 128 from its vent position (as shown in FIG. 3) to a supply position providing air to the grooves 129 for giving air-lift to the machine whereby it can be easily manually moved to the next honing station.

To operate the machine on a power stroke it is necessary to lock the clamps 82 and 95 so as to set the desire lower and upper stroke limits. This is accomplished by first manually pulling down on the handle 50 to lower the honing tool 52 into the selected cylinder bore until the bottom of the tool is about ½" below the cylinder as illustrated in FIG. 4. At that time the piston rod 64 is at the top of its stroke engaging the head 81' of the upper travel limit valve 81. The front clamp is loosened so that the spring 84 will push the stop unit 82 upwardly into engagement with the bumper 90. Then the head unit 47 is manually swung upwardly until about one inch of the honing stones are exposed above the engine block as illustrated generally in FIG. 5. The rear clamp 95 is then locked on the piston rod 64 by pulling on the handle 96. This sets the upper travel limit. The honing stones are then expanded, the power is activated for turning the honing tool, and the solenoid valve 121 is energized so that its spool is in the position shown in FIG. 3.

Since at that moment the piston rod 64 is at its upper limit of travel, the spool of the upper travel limit valve 81 will be in its raised active position wherein its spool will be shifted out of the inactive venting position illustrated in FIG. 3. When the valve 81 is in its active position it connects the supply line 120 to the pilot 114. At that moment the lower travel limit valve 86 will be in its inactive venting position. Hence, the spool of the control valve 113 will shift to make the flow connection illustrated in FIG. 3 wherein the supply line 110 is connected to the line 116 leading to the upper end of the air cylinder 70. This results in downward movement of the piston rod 64 away from the upper valve 81 whereupon that valve shifts to the inactive vent position shown in FIG. 3. Since at that time both pilots 114, 115 are vented the control valve 113 stays in the position for supplying air to the upper side of the piston 78 and for venting air from the lower side of the cylinder 70. As the air piston 78 is forced downwardly its travel speed is limited by the flow rate of oil from the lower side of the oil cylinder 74 to the upper side via the by-pass line 102 and needle valve 103 which is adjusted to obtain the preferred piston travel speed.

As the piston rod 64 travels downwardly the valves 81, 86, 113, 118 and 121 remain in the position illustrated in FIG. 3 until the bumper 90 engages the stop unit 82 and the screw 87 engages the head 86' of the lower travel limit valve 86, whereupon the spool of valve 86 shifts out of the venting position and connects the supply line 110 with the pilot 115. This causes the control valve 113 to shift out of the FIG. 3 position to a position wherein the upper side of the air cylinder 70 is vented through line 116 and the control valve 113, and the lower side of the air cylinder is pressurized by air passing to line 117 from the supply line 110 through the control valve 113. The cycle continues repeatedly until the solenoid valve 121 is deenergized causing it to shift to a position venting line 120 and blocking the supply to the upper valve 81 so that when the valve 81 is next engaged by the bumper 98 at the top of the piston rod 64 it will remain in that raised position because the supply line to the pilot 114 will have been shut off by the solenoid valve and the pilot 114 will remain vented.

From the foregoing description it can be seen that the operator can easily set the upper and lower limits of travel for power stroking by:

(1) setting the lower limit as shown in FIG. 4 by turning the handle 83 of the lower clamp when the honing tool is at the desired lower limit; and (2) setting the upper limit as shown in FIG. 5 by turning the handle 96 of the upper clamp when the honing tool has been manually raised to the desired upper limit. The machine then reciprocates between the set limits as illustrated in FIG. 6.

We claim:

1. In a honing machine of the type having a base assembly, a power head unit mounted for vertical swinging movement on the base assembly, and a honing tool assembly suspended from a universal drive connection with the head unit, the improvement comprising, double-acting cylinder means pivotally mounted on the base assembly for reciprocating said head unit up and down, and including a piston rod, first clamping means pivotally mounted on the head unit and operatively associated with said piston rod for selectively clamping the head unit to the piston rod at selected locations therealong to define an upper limit of swing movement of the head unit, said head unit being free to be hand stroked up and down when said first clamping means is not engaged, a second rod carried by said cylinder means in parallel relation to said piston rod and slidably received by said first clamping, and second clamping means slidably mounted on said second rod below the head unit and adapted to grip the second rod at selected locations therealong, said second clamping means being arranged to be engaged by said first clamping means to define the lower limit of swing movement of the head unit when the head unit is power stroked or manually stroked up and down.

2. A honing machine according to claim 1 in which said double-acting cylinder means includes a pneumatic cylinder unit having a double-acting piston connected to said piston rod, a hydraulic cylinder unit having its ends hydraulically interconnected and having a double-acting piston connected to said piston rod, and flow control means for controlling the rate of flow of fluid back and forth between the ends of said hydraulic cylinder to responsively control the speed of said piston rod when air powered by said pneumatic cylinder unit.

3. A honing machine according to claim 1 in which said double-acting cylinder means is pneumatic and hydraulic speed dampening means is connected to said piston rod.

4. A honing machine according to claim 1 in which said double-acting cylinder means comprises a pneumatic cylinder unit having a double-acting piston connected to said piston rod, and a pneumatic control system for alternately supplying compressed air to the opposite ends of said pneumatic cylinder unit and venting the air from said opposite ends when it is desired to power stroke said head unit, said control system including an upper valve unit carried by said second rod and arranged to be operated by engagement with said piston rod when the latter is at its upper limit of travel to cause compressed air to be supplied to the upper end of said pneumatic cylinder unit and the lower end thereof to be vented, and including a lower valve unit carried by said second clamping means and arranged to be operated by engagement with said first clamping means when the head unit is at its lower limit of travel to cause compressed air to be supplied to the lower end of said pneumatic cylinder unit and the upper end thereof to be vented.

5. A honing machine according to claim 4 in which hydraulic speed dampening means is connected between said pneumatic cylinder and said piston rod.

6. A honing machine according to claim 4 in which said pneumatic control system includes a dwell control valve arranged to selectively vent the lower end of said cylinder unit whereby the honing tool will remain at its lower limit of travel.

7. A honing machine according to claim 4 in which said pneumatic control system includes a solenoid valve which is normally active when the head unit is being power stroked, said solenoid valve being arranged when deenergized to cause venting of the upper end of said pneumatic cylinder unit to remain vented when said unit is operated by engagement with the piston rod and thereby cause the piston rod to dwell in its uppermost position when the pneumatic control system is to be deactivated.

8. A honing machine according to claim 1 in which shock absorbing means is mounted on one of said first and second clamping means for engagement by the other when the head unit reaches its lower limit of swing movement.

9. A honing machine according to claim 4 in which shock absorbing means is mounted on one of said first and second clamping means for engagement by the other when the head unit reaches its lower limit of swing movement, said shock absorbing means being arranged to commence operation before said lower valve unit is operated by engagement with said first clamping means.

10. A honing machine according to claim 4 in which the upper end of said piston rod has shock absorber means arranged to be in engagement with said upper valve unit when the piston rod is at its upper limit of travel.

11. A honing machine according to claim 1 in which said first clamping means comprises a block pivotally mounted intermediate its ends to said head unit, a clamp at one end of the block for selectively clamping the block to the piston rod, and a slide at the opposite end of the block for receiving said second rod.

12. A honing device according to claim 4 in which said first clamping means has a depending adjustable screw arranged to engage said lower valve unit when the head unit is at its lower limit of travel.

13. A honing machine according to claim 2 in which a mounting member for the lower end of the second rod is connected between said pneumatic and hydraulic cylinder units.

14. In a honing machine of the type having a base assembly, a power head unit mounted for vertical swinging movement on the base assembly, and a honing tool assembly suspended from a universal drive connection with the head unit, the improvement comprising, an upstanding rod means pivotally mounted at its lower end on the base assembly, said rod means comprising a double-acting cylinder means for reciprocating said head unit up and down and including a piston rod, and a second rod in parallel relation to the piston rod, head block means slidably receiving said rods and pivotally connected to said head unit intermediate said rods, a first clamp on said head block means for selectively clamping the head block means to the piston rod to thereby selectively clamp the head unit to the piston rod at selected locations therealong to define an upper limit of swing movement of the head unit, said head unit being free to be hand stroked up and down when said first clamp is not engaged, stop block means slidably mounted on the second rod below said head block means for engagement by the latter when the head unit is at its lower limit of swing movement, and a second clamp on said stop block means for selectively clamping the stop block means to the second rod to define said lower limit.

15. A honing machine according to claim 14 in which said double-acting cylinder means is pneumatic and said rod means also has a hydraulic speed control means connected to said piston rod.

16. A honing machine according to claim 14 in which said double-acting cylinder means comprises a pneumatic cylinder having a double-acting piston connected to said piston rod, and a pneumatic control system for alternately supplying compressed air to the opposite ends of said pneumatic cylinder and venting the air from said opposite ends for power stroking the head unit.

17. A honing machine according to claim 16 in which said control system includes an upper travel limit control valve on said head block and a lower travel limit control valve on said stop block arranged respectively, to be engaged by said piston rod and head block.

* * * * *